US007398914B1

(12) United States Patent
Baum

(10) Patent No.: US 7,398,914 B1
(45) Date of Patent: Jul. 15, 2008

(54) CONSUMER KIOSK/SURVEY BOX CONSTRUCTION

(76) Inventor: Jeffrey S. Baum, c/o Schweitzer Cornman Gross & Bondell LLP, 292 Madison Ave., 19th Floor, New York, NY (US) 10017

( * ) Notice: Subject to any disclaimer, the term of this patent is extended or adjusted under 35 U.S.C. 154(b) by 0 days.

(21) Appl. No.: 11/735,700

(22) Filed: Apr. 16, 2007

(51) Int. Cl.
*G07C 13/02* (2006.01)

(52) U.S. Cl. ..... 232/2; 232/1 D

(58) Field of Classification Search ..... 232/2, 232/1 D, 43.1; 312/114, 138.1, 211, 327–328; 108/108; 211/85.26, 71.01; 40/606.12, 606.05, 40/606.06

See application file for complete search history.

(56) References Cited

U.S. PATENT DOCUMENTS 3,211,366 A * 10/1965 Draddy et al. ..... 232/2
3,229,902 A * 1/1966 Draddy et al. ..... 232/2
3,517,905 A * 6/1970 Nestegard ..... 248/469
4,608,773 A * 9/1986 White ..... 40/606.01
4,699,312 A * 10/1987 Owen ..... 232/2
D324,790 S * 3/1992 Krautsack ..... D6/455
5,542,554 A * 8/1996 Resnick ..... 211/186
5,787,621 A * 8/1998 Leksell ..... 40/607.03
5,966,857 A * 10/1999 Pettersson et al. ..... 40/606.12
6,279,822 B1 * 8/2001 Bertram ..... 40/606.05
6,648,144 B2 * 11/2003 Vogel ..... 209/554

* cited by examiner

*Primary Examiner*—William L. Miller
(74) *Attorney, Agent, or Firm*—Schweitzer Cornman Gross & Bondell LLP

(57) ABSTRACT

A display kiosk, which has particular utility as a consumer ballot or survey box, has a receptacle supported by a leg assembly. The receptacle has front and back walls joined together a their lateral edges by stiffeners, thus avoiding the need for separate side walls. Top and bottom walls are formed integrally with one of the front or back walls. The lateral edges of the front wall are retained by, but not fastened to, the stiffeners, allowing overlying front panel sheets to be mounted to the front wall by inserting their lateral edges between the front surface of the front wall and the overlying rear surface of the stiffeners. When used as a ballot or survey box, a ballot slot is provided on the front wall and an integral access door to the receptacle interior is located on the front wall.

20 Claims, 8 Drawing Sheets

FIG. 2
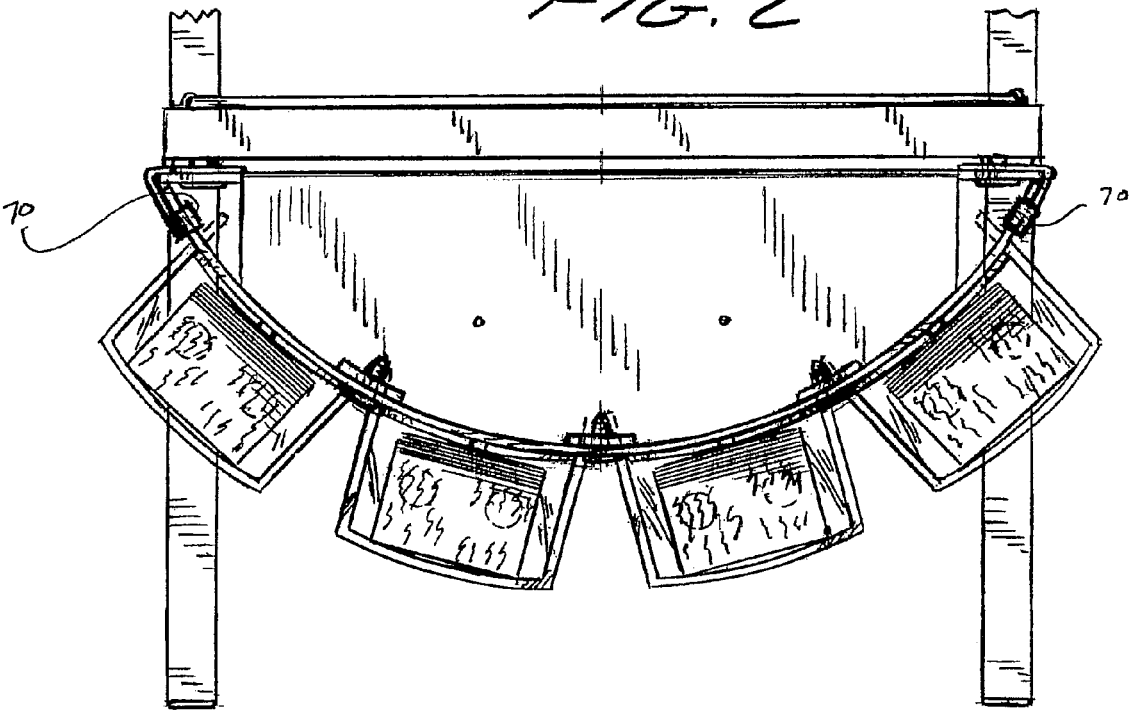
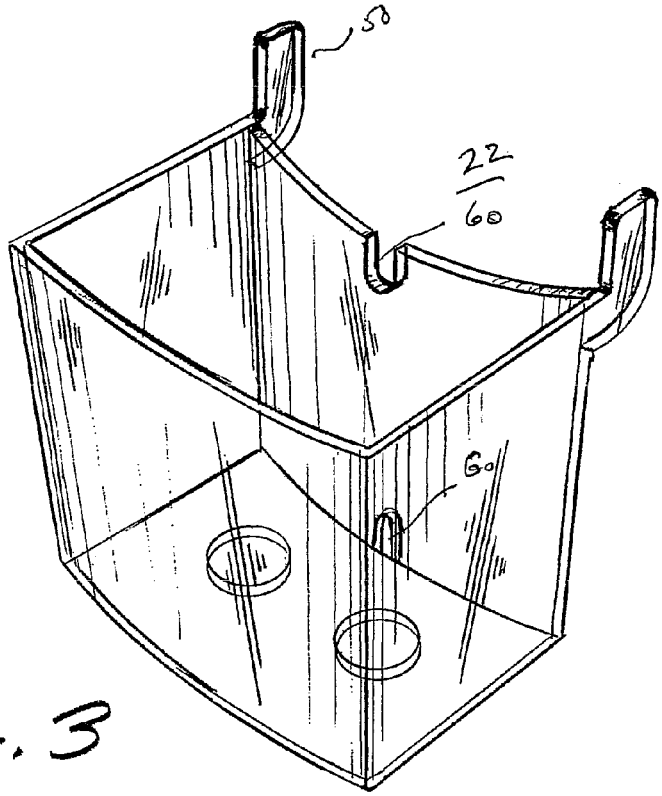
FIG. 3

FIG. 10
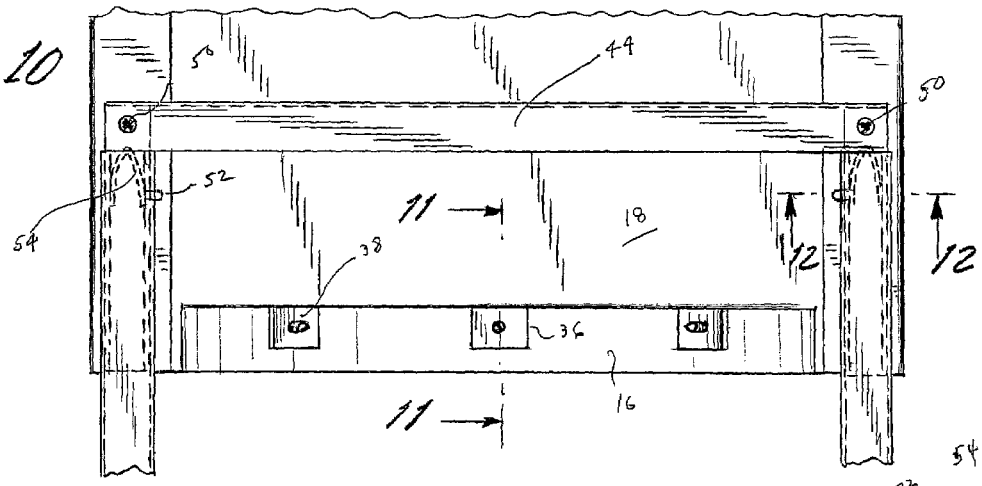
FIG. 11
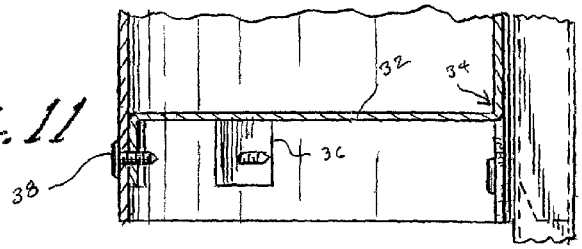
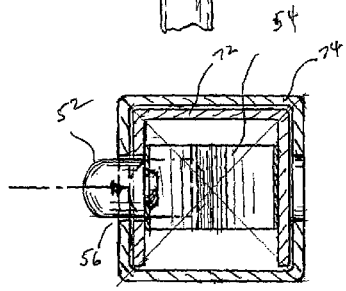
FIG. 12

CONSUMER KIOSK/SURVEY BOX CONSTRUCTION

The present invention relates to a new and improved construction for a display kiosk construction, having particular utility as a survey or ballot box particularly adapted for use in public areas, such as retail stores, sporting arenas and the like.

BACKGROUND OF THE INVENTION

The measurement of consumer preferences in a semi-informal manner is of significant interest and widespread applicability. Major League sports, for example, solicit the votes of fans with respect to players to be chosen for the leagues' All Star Teams. Major League Baseball garners millions of fan ballots for its all-star game. In addition, manufacturers of consumer goods often run promotional campaigns in which consumers can enter a contest through a balloting system incorporated into point of sale displays, or in which consumers vote for a favorite variety or flavor of candy, beverage, etc.

Much of such balloting is conducted through paper ballots, which are made available to consumers at retail establishments, at sports venues, etc. In addition to supplying blank forms or ballots, the display ballot box typically includes a container into which the completed ballots can be deposited. The ballot box typically is adorned with attractive indicia advertising the competition for which votes are solicited, as well as oftentimes promoting one or more sponsoring organizations. Because of the large number of locations in which the ballot boxes are placed, the construction of such ballot boxes is greatly cost-sensitive. While it is important that the ballot boxes are both attractive and relatively robust, they preferably must be light in weight, easily transportable and easily assembled and disassembled. In addition, it would be of substantial benefit if they can serve multiple purposes. Lastly, they should be of an economical construction.

A box or receptacle having the aforementioned qualities has additional uses. In addition to offering ballots or contest materials, it can also serve as a display for a variety of literature, information, or products, either with materials to be deposited in the receptacle, such as a reply coupon or application, or without such return materials, in which case the receptacle serves primarily as a display kiosk.

It is accordingly the purpose of the present invention to provide a box or receptacle, which may be configured as a ballot box or similar receptacle meeting the aforementioned requirements.

BRIEF DESCRIPTION OF THE INVENTION

In further accordance with the foregoing, a display kiosk construction of the present invention comprises a collapsible stand to which a receptacle is mounted. The receptacle has front and rear walls, one of which is bowed to allow the walls to be joined at their side edges to avoid the need for sidewalls. The joined side edges are reinforced with stiffener angle elements. The receptacle walls are of a lightweight, rigid material, such as plastic board or cardboard, as appropriate. In addition to the stiffener angle elements maintaining the receptacle walls in the appropriate configuration, it also allows for the insertion of overlying face panels for the front wall, allowing the appearance of the receptacle to be changed without the necessity for either box replacement or disassembly.

Preferably, top and bottom walls for the receptacle are formed integrally with one of the front or rear walls, as is an access door to the receptacle interior. Holders for blank survey cards, ballots, or other materials, such as product samples, can be mounted to the front wall of the receptacle, which also includes a slot for survey/ballot deposit when configured as a ballot or survey box. When used as a display kiosk without a deposit requirement, the slot can be dispensed with. An access door, preferably located on the rear wall, allows collected ballots to be removed from the receptacle. When used as a display kiosk the access door can similarly be dispensed with.

The construction is both structurally rigid and attractive, can be assembled quickly and economically, and can be produced at relatively low cost.

BRIEF DESCRIPTION OF THE DRAWINGS

A fuller understanding of the present invention will be achieved upon review of the following detailed description of a preferred, but nonetheless illustrative embodiment of the invention in the form of a ballot or survey box when reviewed in conjunction with the annexed drawings, wherein:

FIG. 2 is a top plan view of the ballot box, taken along line 2-2 of FIG. 1;

FIG. 3 is a perspective view of a ballot holder mountable upon the front wall of the ballot box;

FIG. 10 is a rear elevation detailing the lower part of the ballot box receptacle and its mounting to the stand;

FIG. 11 is a partial section view taken along line 11-11 of FIG. 10;

FIG. 12 is a section view of a stand leg taken along line 12-12 of FIG. 10;

DETAILED DESCRIPTION OF THE INVENTION

Figure 1:
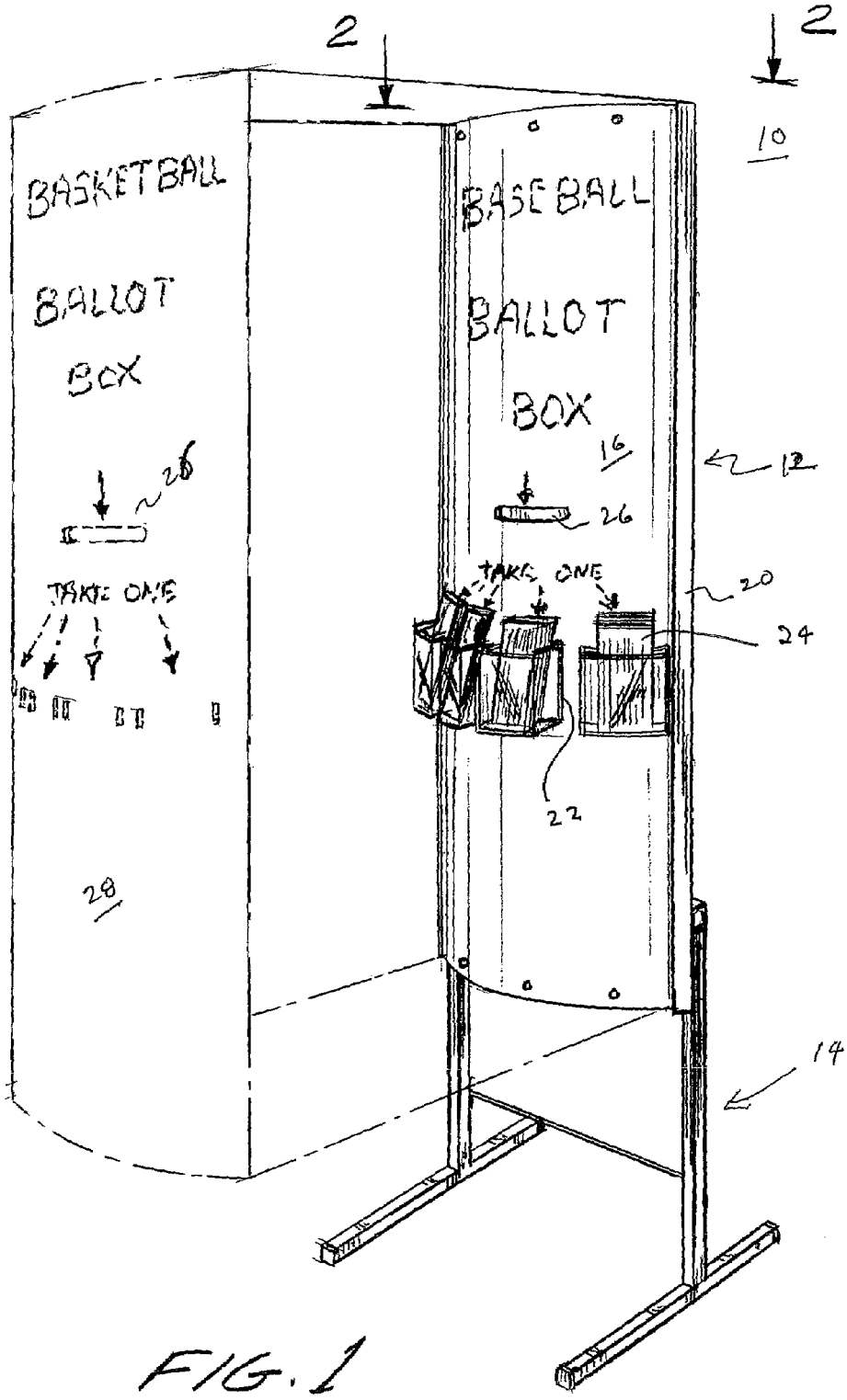
FIG. 1 is a perspective view of a ballot box of the present invention, depicting in phantom a replacement overlying front panel.
Figure 4:
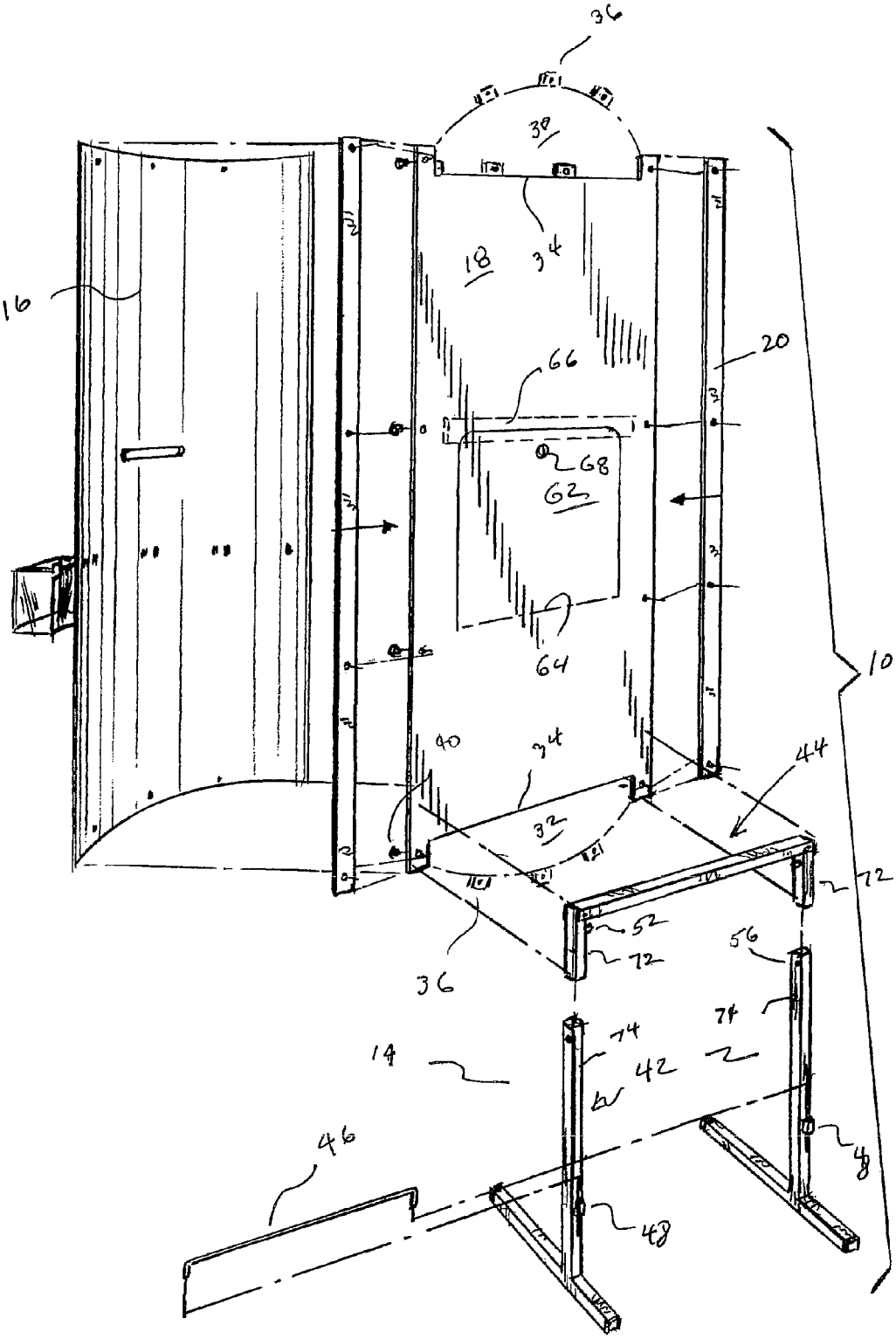
FIG. 4 is an exploded view of the ballot box illustrating its assembly.
Figure 5:
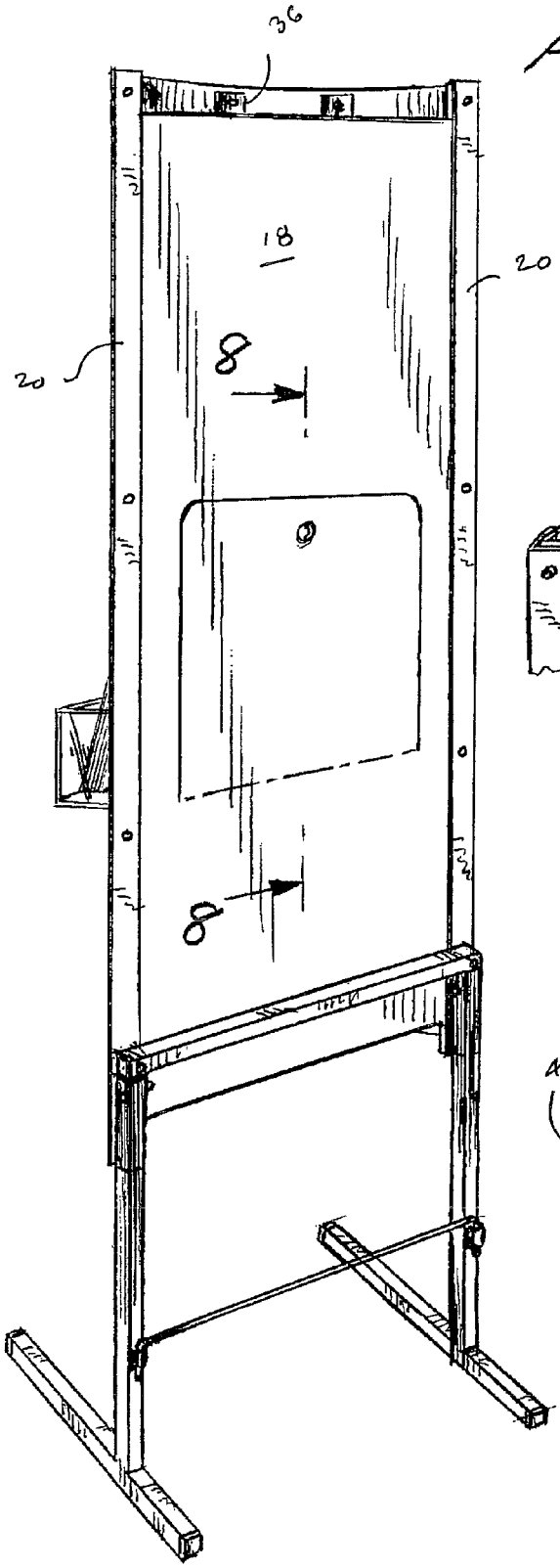
FIG. 5 is a rear perspective view of the ballot box.

With particular reference to FIGS. 1 and 4, ballot box construction 10 includes a ballot-receiving receptacle 12 mounted to leg assembly 14. The ballot receptacle 12 is formed with a curved front wall 16 and a generally planar rear wall 18, abutting at their aligned vertical lateral edges and avoiding the need for separate side walls for the receptacle. A pair of vertically-extending stiffener corner angle elements 20 hold the abutting lateral edges together. A plurality of ballot containers 22 are mounted to the front wall, and each hold a plurality of ballots 24 which, when completed, are inserted through front wall slot 26 for collection within the ballot receptacle 12. As will be discussed, infra, a replacement front panel 28 can be provided to overlie the front wall 16 to provide a different appearance for the receptacle unit.

The back wall 18 may be formed of an appropriate light but rigid material, such as a corrugated plastic. The front wall 16 may be of a more flexible material, such as a relatively thick plastic or cardboard laminate, having a front surface printed with appropriate advertising/promotional indicia as desired, while the replacement front panel 28 may be of a thinner gauge plastic or cardboard with a similarly printed front surface.

Figure 6:
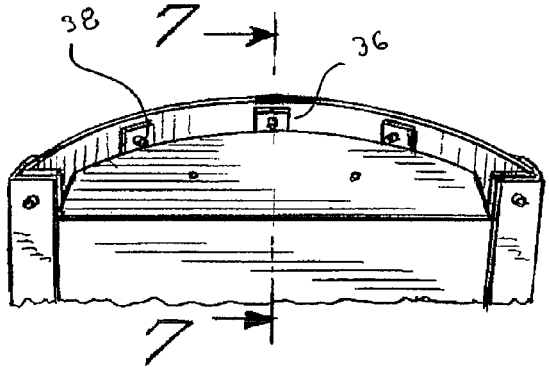
FIG. 6 is a rear perspective detail view of the top portion of the ballot box.
Figure 7:
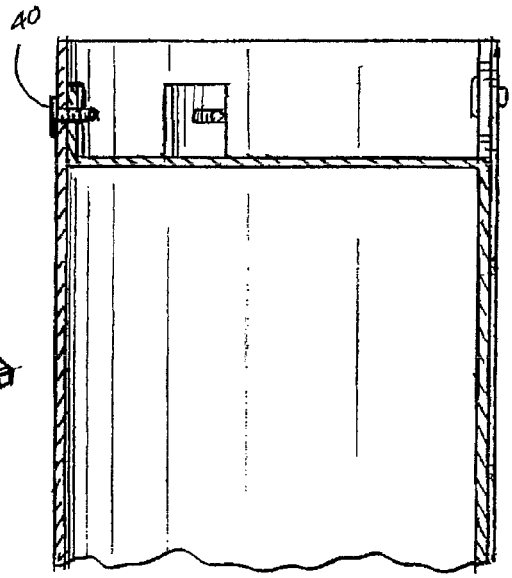
FIG. 7 is a partial section view taken along line 7-7 of FIG. 6.
Figure 8:
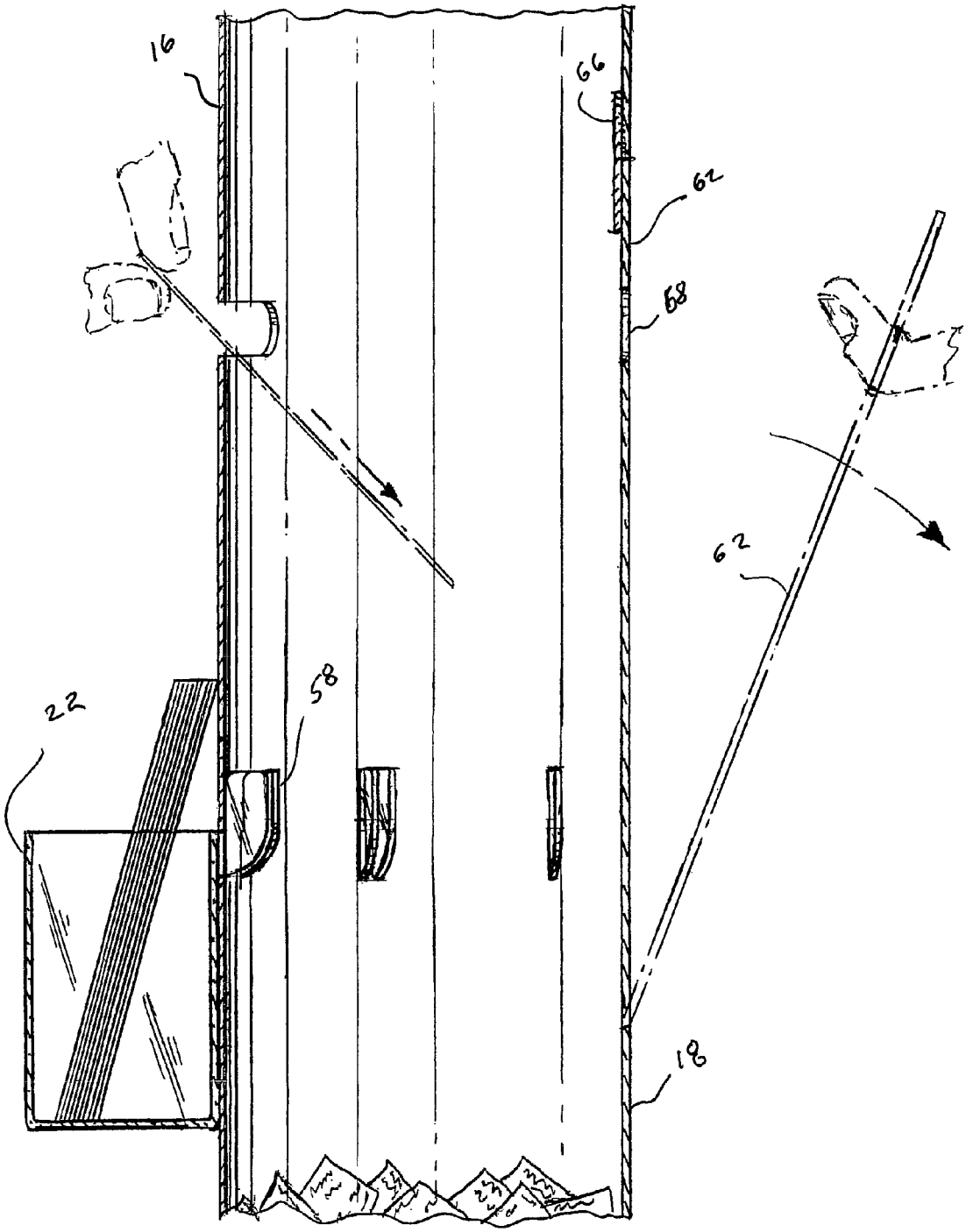
FIG. 8 is a partial section view taken along line 8-8 of FIG. 5, depicting ballot deposition and opening of a rear aperture for access to deposited ballots.

As further detailed in FIG. 4, rear wall panel 18 is of generally rectangular configuration, but is formed, such as by die cutting, from a blank with integral upper and lower arcuate panel segments 30, 32, shown in phantom in an upright orientation. The segments are joined to the real wall panel portion by scored fold lines 34, which allow the segments to be folded horizontally forward, as illustrated by the top segment in FIG. 6, to form top and bottom walls for the receptacle 12. The curvature of the arcuate edge of each of the segments conforms to the curvature of front wall 16 when in the assembled configuration. The fold lines 34 may be located inwardly from the top and bottom margins of the rear wall 18. Each of the segments 30, 32 is further provided with foldable tabs 36, similarly having a scored fold line, to allow the tabs to be folded perpendicular to the associated arcuate segment to provide a connection surface abutting the rear surface of front wall 16. Fasteners 38, such as screws, pins or rivets, mount the front wall 16 to the upper and lower arcuate segments 30, 32 and maintain the front panel in the desired curved configuration. See, e.g., FIGS. 6, 7 and 11.

Vertically-extending stiffener angle elements 20, constructed of an appropriate rigid material such as steel or aluminum or an extruded plastic, extend the length of the rear wall 18, and are mounted to the opposed lateral edges of the rear wall by additional fasteners, such as rivets 40. The angled cross-section of the stiffeners, as perhaps best seen in FIGS. 6 and 13, engage and retain the lateral side edges of front wall 16 to maintain the curved configuration of the front wall. It is to be noted, however, that the front wall is not otherwise fastened to the corner angles. In assembling the ballot receptacle 12, it is advantageous to install the stiffener angle elements to the rear wall 18 before the front wall is joined. In addition to providing retaining support for the lateral edges of the front wall when curved, it also allows the enlarged heads of rivets 40 to bear against the relatively soft surface of the rear wall to provide a more secure connection.

As further shown in FIG. 4, the ballot receptacle 12 is supported at a convenient height by leg assembly 14, which engages a downwardly directed U-shaped connector 44 with arms 72 mounted to the lower end of receptacle rear wall 18. Connector 44 is formed of appropriate gauge steel or aluminum rectangular tube stock, and is fastened to rear wall 18 and stiffener angle elements 20 by screws 50.

The leg assembly comprises a pair of generally T-shaped legs 42 similarly formed of an appropriate gauge steel or aluminum rectangular tube stock, with the vertical portions 74 thereof dimensioned to receive the downwardly-extending arms 72 of connector 44. A U-shaped cross wire 46 further extends between the verticals, the downwardly-folded ends thereof being insertable into a pair of retention clips 48 on the verticals.

A locking mechanism retains the verticals 74 within the arms 72 of connector 44. As further detailed in FIGS. 10 and 12, a latch button 52 is mounted in the upper portion of each of the connector arms 72, and is biased outwardly through a bore in the arm by folded leaf spring 54 within the interior of the arm. The vertical portions 74 of the legs 42 have button-accepting bores 56. When the legs are mounted upon the connector 44, manual depression of the buttons 52 allows full insertion of the connector arms into the legs. When the bores 56 on the legs align with the buttons, springs 54 biases the buttons through the leg bores 56, providing a locking function. The buttons may be easily depressed with finger pressure when disassembly is desired.

Figure 9:
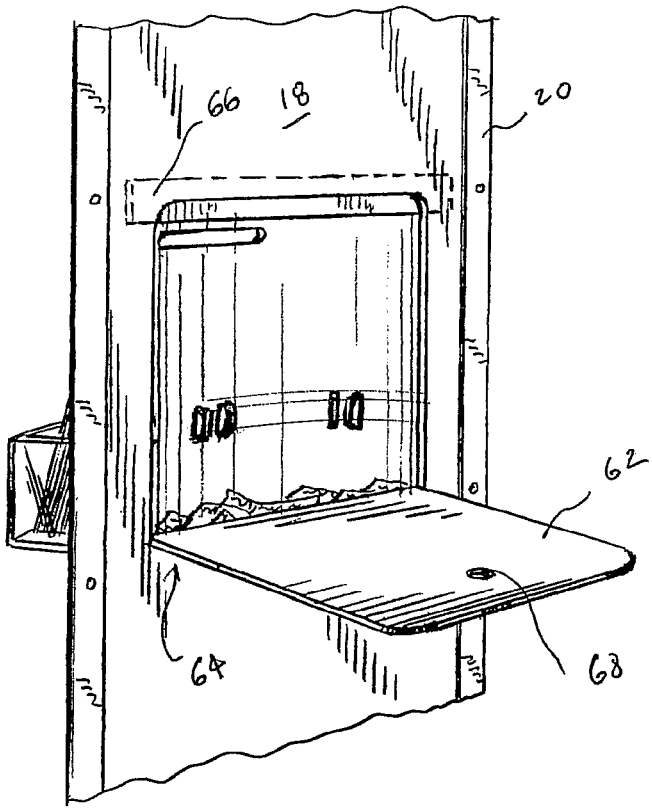
FIG. 9 is a detail perspective view of the rear access aperture.

FIG. 3 depicts the construction of an illustrative ballot holder 22. The ballot holder may be constructed of any appropriate material, such as a clear plastic, and is formed with a curved rear wall to conform to the curvature of front wall 16. A pair of flanges 58 is provided, which engage corresponding pairs of rectangular apertures on the front wall 16, allowing the receptacles to be mounted thereto, as depicted in FIG. 2. Cut-out portions 60 of the ballot receptacle rear wall allow the receptacles to be fastened to the front wall. Upon completion, the ballots are collected by the receptacle as they are inserted through front slot 26. As shown in FIGS. 4 and 9, rear wall 18 is provided with an integral access door 62, die-cut on three sides and with integral hinge/fold line 64 to allow access to the receptacle interior for collection of the ballots. A crossbar 66 may be mounted to the interior of the rear wall overlying the top edge of the door to prevent the door from being pushed inward beyond the vertical. A finger hole 68 may be provided in the rear door to facilitate opening. In addition to ballots, surveys or other cord-like materials, the ballot holder 22 can hold and dispense other materials, such as, applications, information sheets, or product samples.

Figure 14:
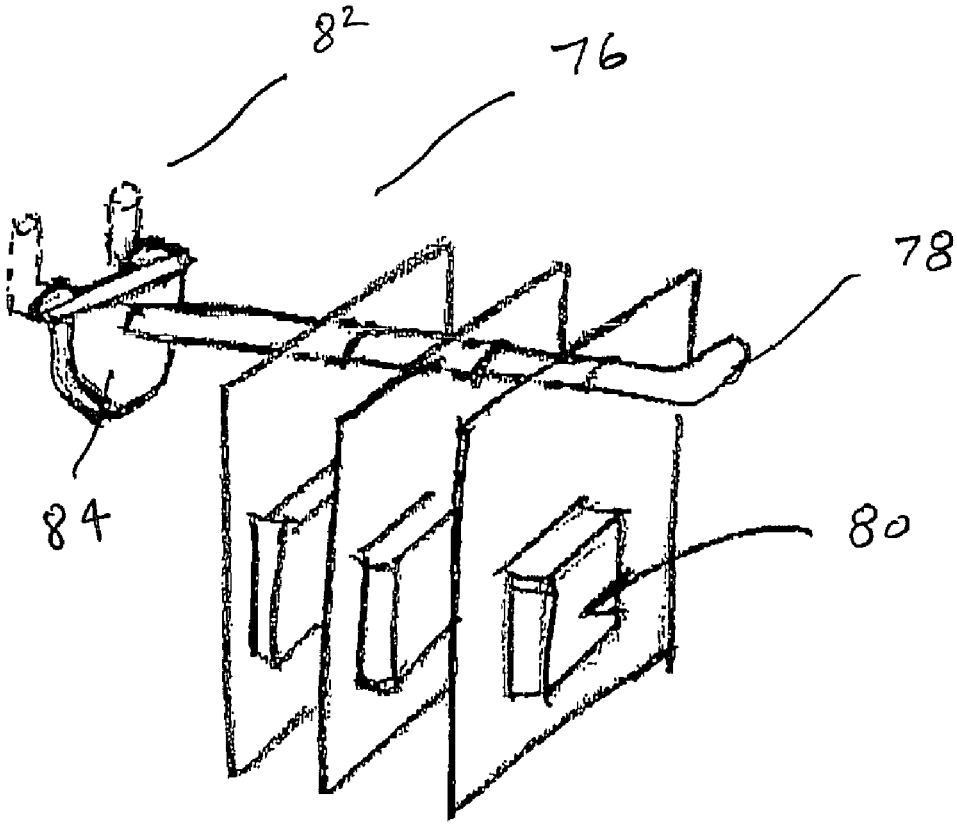
FIG. 14 is a perspective view of an alternative to a ballot holder able to be mounted to the receptacle.

As further depicted in FIG. 14, other holder constructions can similarly be employed and mounted to the front wall 16. Product hook 76 includes hook arm 78 upon which carded products 80 are hung. Flanges 82, shown here as being cylindrical. extend upward and rearwardly from base portion 84, to engage corresponding circular apertures in the front wall. The particular shape of the flanges and the corresponding front wall are a matter of choice.

Figure 13:
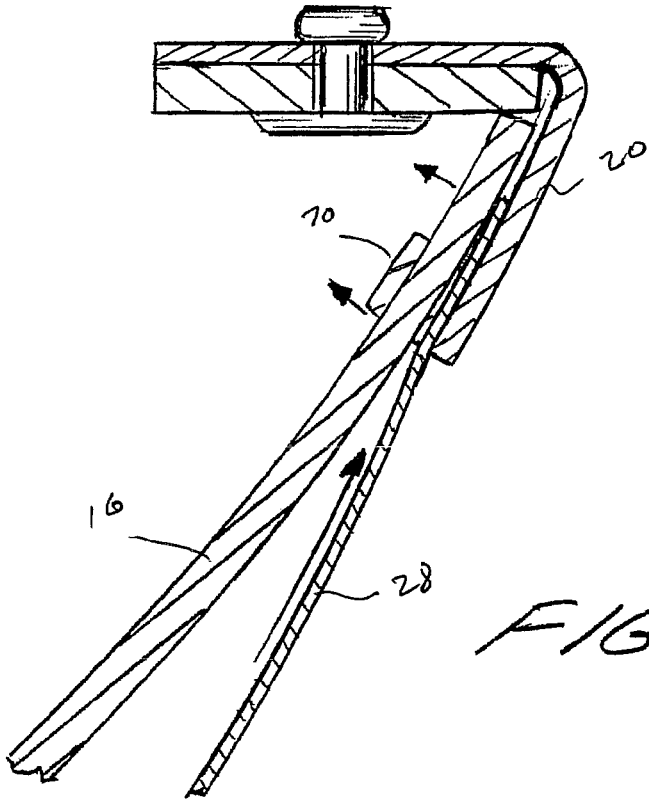
FIG. 13 is a detail top plan view of a corner of the receptacle illustrating the insertion of an auxiliary panel upon the front wall of the receptacle.

As depicted generally in FIG. 1, the front wall 16 may be provided with appropriate indicia to attract and instruct potential voters/users. One or more alternative overlying front panels 28 may be provided, however, such panels having a ballot slot 26 and apertures appropriately located to accommodate the ballot receptacle flanges 58. As front wall 16 has no mechanical fasteners between it and the corner angles 20, an overlying front panel 28 can be easily mounted to the ballot receptacle and front wall by inserting the side vertical edges of the panel 28 between the front surface of front wall 16 and the corner angle 20, as detailed in FIG. 13. The resiliency of the front wall 16 allows the additional panel to be inserted and retained in a friction-fit between the front wall and the corner angles 20 without further mechanical connection. Each of the corner angle elements 20 may be provided with a small inwardly-directed tab or return 70 at its top and bottom, as seen in FIGS. 2 and 13, which retains the overlying panel 28, and prevents vertical travel in the event the friction fit is insufficient. The overlying panel is thus maintained firmly in position without the need for any further fastenings.

From the foregoing, it may be appreciated that the present invention provides a ballot box-type construction which is of economical construction and assembly, and which may be easily adapted for a variety of promotional purposes. Those skilled in the art can appreciate that modifications and adaptations of the invention as depicted herein may be achieved without departing from the scope of the invention, which scope is to be measured by the annexed claims.

I claim:

1. A survey/ballot box for receiving and retaining ballots, comprising a receptacle supported by a leg assembly, the receptacle having front and rear vertical walls with abutting vertical edges, a ballot entranceway in one of the walls, the front and rear walls defining a collection space therebetween for receipt and retention of the ballots, corner angle elements extending substantially along the abutting vertical edges, and a connector mounted to the rear wall for engaging the leg assembly.

2. The survey/ballot box of claim 1, wherein at least one of the front and rear walls is arcuate between its vertical edges.

3. The survey/ballot box of claim 2 wherein the front wall is arcuate and the rear wall is planar.

4. The survey/ballot box of claim 3 wherein the receptacle further comprises top and bottom walls, the top and bottom walls and the rear wall being of a unitary sheet of material.

5. The survey/ballot box of claim 4 wherein the top and bottom walls are each joined to the rear wall by an integral fold line forming a hinge.

6. The survey/ballot box of claim 5 wherein the top and bottom walls each have an arcuate front edge portion that abuts the front wall.

7. The survey/ballot box of claim 6 wherein the arcuate front edge portion of at least one of the top and bottom walls includes integral connecting tabs for the front wall.

8. The survey/ballot box of claim 7 wherein the connecting tabs are joined to the arcuate front edge by integral fold lines forming hinges.

9. The survey/ballot box of claim 4 wherein the corner angle elements are fastened to the rear wall but not the front wall.

10. The survey/ballot box of claim 9 wherein the vertical edges of the front wall are in frictional engagement with inner surfaces of the corner angle elements.

11. The survey/ballot box of claim 10 wherein the corner angle elements have a return at least one end extending over an end of the front wall.

12. The survey/ballot box of claim 9 further including a removable sheet freely overlying a front surface of the front wall, the sheet having a pair of side edges generally aligned with the vertical edges of the front wall and being frictionally retained between inner surfaces of the cover angle elements and the vertical edges of the front wall.

13. The survey/ballot box of claim 1 further comprising display means mounted to one of the walls.

14. The survey/ballot box of claim 13 wherein the display means comprise at least one ballot/survey holder.

15. The survey/ballot box of claim 13 wherein the one wall includes apertures, and the display means include hooks to engage the apertures and support the display means upon the one wall.

16. The survey/ballot box of claim 3 wherein the leg assembly connector is of an inverted U shape with downwardly extending arms.

17. The survey/ballot box of claim 16 wherein the leg assembly comprises a pair of inverted T legs with upwardly extending leg portions and a removable support extending therebetween.

18. The survey/ballot box of claim 17 wherein the leg assembly leg portions and the leg assembly connector arms are removably interconnected.

19. The survey/ballot box of claim 18 further comprising a locking assembly associated with the leg assembly leg portions and the leg assembly connector arms.

20. The survey/ballot box of claim 19 wherein the locking assembly comprises a spring loaded button and an associated acceptance bore.

* * * * *